United States Patent [19]

Young

[11] 4,185,342

[45] Jan. 29, 1980

[54] PORTABLE, ADJUSTABLE BACKREST FOR BEDS AND THE LIKE

[76] Inventor: Raymond E. Young, 10717 Juniper Hills Rd., Littlerock, Calif. 93543

[21] Appl. No.: 916,265

[22] Filed: Jun. 16, 1978

[51] Int. Cl.[2] ..... A47C 21/00

[52] U.S. Cl. ..... 5/433; 5/79; 297/377

[58] Field of Search ..... 5/70, 79, 317, 327, 5/433; 248/346.1; 297/377

[56] References Cited

U.S. PATENT DOCUMENTS

| | | | |
|---|---|---|---|
| 1,404,482 | 1/1922 | Sawyer | 5/79 |
| 1,658,737 | 2/1928 | Ortmeier | 5/79 |
| 1,798,901 | 3/1931 | Puret | 248/345.1 |
| 3,264,382 | 8/1966 | Angell et al. | 297/396 |
| 3,931,653 | 1/1970 | Bien | 5/79 |

*Primary Examiner*—Casmir A. Nunberg
*Attorney, Agent, or Firm*—Jack C. Munro

[57] ABSTRACT

A portable, adjustable backrest for use primarily on a bed, sofa or the like which takes the form of a backrest panel which is hingedly connected to a base which is to be placed upon the bed, sofa or the like. The backrest panel is to be adjustable with respect to the base in various inclined positions. The adjustments of the backrest panel is provided through a crank arm assembly which operates through a disc assembly which in turn rolls upon a thin flexible strap assembly. An arm assembly is attached to the disc assembly which is to pivot with the disc assembly. The outer end of the arm assembly is to be in contact with the backside of the backrest panel. The pivoting of the arm assembly to different positions results in locating of the backrest panel to various inclined positions with respect to the base.

8 Claims, 6 Drawing Figures

PORTABLE, ADJUSTABLE BACKREST FOR BEDS AND THE LIKE

BACKGROUND OF THE INVENTION

Persons recuperating from an illness, particularly older people, are frequently required to be bedridden for an extended period of time. For purpose of comfort the bedridden patient does not desire to be continuously prone. Therefore, patients frequently prefer to assume a semi-sitting position in which the head and upper torso of the patient is raised at an inclined position with respect to the bed.

Previously, it has been known to modify a conventional flat mattress to include some provision of an inclined backrest. The structures of the prior art normally include some provision for adjustment usually in the form of an inflatable bellows arrangement. Generally speaking, this type of prior art is characterized by complex construction and therefore is expensive to manufacture.

Additionally, the prior art structure does not readily lend itself to use in an individual's home. Frequently a bedridden patient at home does have a certain amount of mobility and is capable of moving from one location to another such as from a bed to a sofa. It would be desirable to design a backrest for use not only on a bed but also for use on a sofa or use on any other location in which the patient could be located.

SUMMARY OF THE INVENTION

The backrest of this invention comprises a planer base member to which is hingedly attached at the front end thereof a backrest planer panel. The backrest planer panel is to be pivoted to various positions with respect to the base to thereby assume various inclined positions of the backrest. A manually operated crank arm assembly is mounted on the base and operates to rotate a threaded rod. The threaded rod operates through a nut assembly which in turn is fixedly secured to a disc assembly. The disc assembly is pivotly mounted upon the base and operates to pivot directly upon a flexible strap assembly. The pivoting of the disc assembly causes pivoting of an arm assembly, the free end of which is low-frictional contact with the back side of the backrest panel. Movement of the arm assembly to various positions with respect to the backrest panel causes the backrest panel to assume various inclined positions with respect to the base. Lateral restraint means are to be employed in the front side of the backrest panel to prevent a patient with limited muscle control from sliding sideways out of contact with the backrest panel. A brace or stop means is attached to the back end of the base and functions to brace the device against a fixed object such as a wall or the back end of the bed and prevent the backrest from moving in a backwards direction during use.

One of the objectives of this invention is to facilitate the use of a portable, adjustable backrest for use in the home and for the most part to be used by people of limited strength, such as women, and therefore which requires little force to operate.

Another advantage of this invention is that it is light in weight thereby facilitating portability and also being compact to facilitate storage when not in use.

A further objective of this invention is to construct a backrest which is non-complex in construction and can be manufactured inexpensively.

DETAILED DESCRIPTION OF THE SHOWN EMBODIMENT

Figure 1:
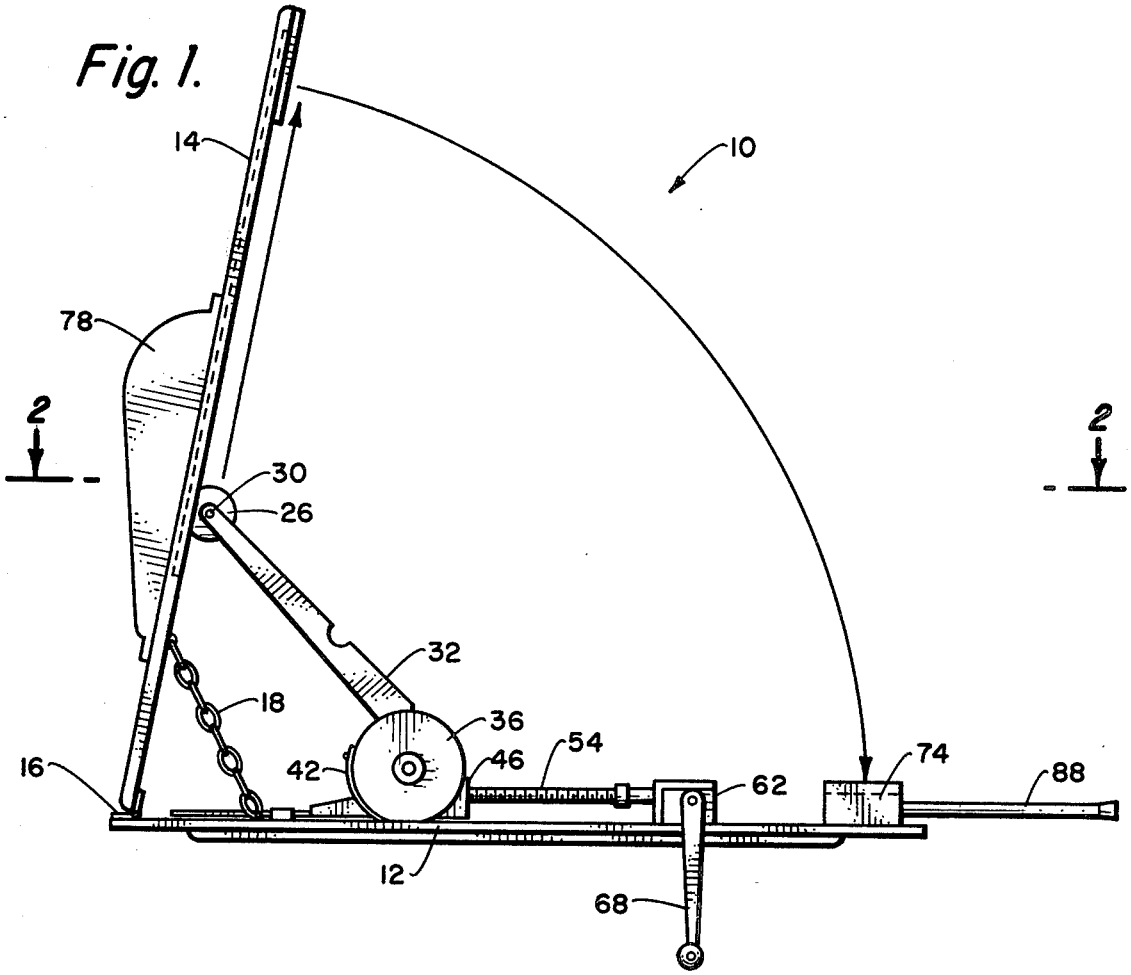
FIG. 1 is a side view of the backrest of this invention showing the backrest in its uppermost position wherein the patient would be in an almost sitting upright position when using the device.

Referring particularly to the drawings there is shown the backrest 10 of this invention which is composed generally of a rectangularly shaped planar base 12 and a rectangularly shaped planer backrest panel 14. Base 12 is adapted to be located upon a planer supportive surface such as a mattress, sofa or the like. The base 12 as well as the backrest panel 14 are to be constructed of any rigid material such as metal, wood or plastic.

The lowermost end of the backrest panel 14 is hingedly connected through a conventional type of hinge assembly 16 to the fore end of the base 12. A pair of chains 18 and 20 are to be interconnected between the rear side of the backrest panel 14 and the upper side of the base 12 so as to limit the outward hinging movement of the back panel 14 with respect to the base 12.

Located on the back side of the backrest panel 14 are a pair of spaced-apart grooves 22 and 24. Groove 22 is to cooperate with roller 26 while groove 24 is to cooperate with a roller 28. The roller 26 is to be in continuous contact with the groove 22 while the roller 28 is to be in continuous contact with the groove 24.

Each of the rollers 26 and 28 are connected together through a rod 30. The rollers 26 and 28 are low-frictionally mounted for rotational movement upon the rod 30. The ends of the rod 30 are fixedly secured to a pair of spaced-apart arms 32 and 34. Arm 32 is fixedly secured to a disc 36 with arm 34 being fixedly secured to a disc 38.Fixedly secured to the periphery of the disc 38 is a flexible metallic strap 40. A similar strap 42 is attached to the periphery of the disc 36. The free end of the strap 40 is fixedly secured by conventional fastening means to the base 12. Similarly the free end of the strap 42 is fixedly secured to the base 12.

The disc 36 is rotatably supported upon one end of a bar 44. The disc 38 is rotatably supported upon the other end of the bar 44. Intermediate the length of the bar 44 there is attached a guide channel 46. The guide channel 46 has confined for limited movement thereto a threaded nut 48. The guide channel 46 also includes an extension flange 50 which cooperates with the guide bracket 52. The function of the guide bracket 52 is to maintain the extension flange 50 as well as the guide channel 46 in close contact with the base 12.

It is to be noted that the nut 48 is loosely held with respect to the guide channel 46 by means of a bail 56, the edges of the guide channel 46 and the forward edge 58 of the bar 44. This loose holding of the nut 48 is desirable so as to eliminate a high degree of tolerance and also permit a certain amount of flexibility of the backrest 14 during use. This flexibility is not only caused by the nut 48 but also by the straps 40 and 42.

The nut 48 is threadingly connected with a threaded rod 54. This threaded rod 54 is connected at one end thereof to a first gear 60. The gear 60 is located within housing 62.

The gear 60 meshes with a gear 64 which is mounted on a crank shaft 66. The crank shaft is rotationally mounted with respect to the housing 62. The free end of the crank shaft 66 is connected with a crank arm 68.

The operation of the backrest of this invention is as follows: It will be assumed that the backrest is in the position shown in FIGS. 3, 4 and 5 of the drawing at which time the backrest panel 14 is located substantially in abutment with the base 12. In this position the rollers 26 and 28 cooperate respectively with guide channels 70 and 72 located within respective guide blocks 74 and 76. The guide blocks 74 and 76 are fixedly mounted on the base 12. By turning of the crank arm 68 in a clockwise direction, threaded rod 54 is rotated through the meshing of the gears 64 and 60. The threaded rod in turn causes the nut 48 to be moved in a direction away from housing 62. This is due to the fact that the loosely held nut 48 acts against the edge 58 of the bar 44. This movement of the bar 44 causes the discs 36 and 38 to roll upon their respective straps 42 and 40. This rolling movement upon the straps results in the arms 32 and 34 being pivoted in a counter-clockwise direction (in reference to FIG. 4). As a result the rollers 26 and 28 push against the bottom of the respective grooves 22 and 24 and cause the backrest panel 14 to assume a raised, inclined position in respect to the base 12. The rollers 26 and 28 may continue to roll within their respective grooves 22 and 24 until in the fully upright inclined position, the backrest panel 14 assumes the position shown in FIG. 1. It should be readily obvious that by reversing the rotation of the crank arm 68, the backrest panel can then be moved back to the position shown in FIGS. 3, 4 and 5. It is to be understood that in most instances of use a particular intermediate position of panel 14 will be selected and maintained.

Figure 3:
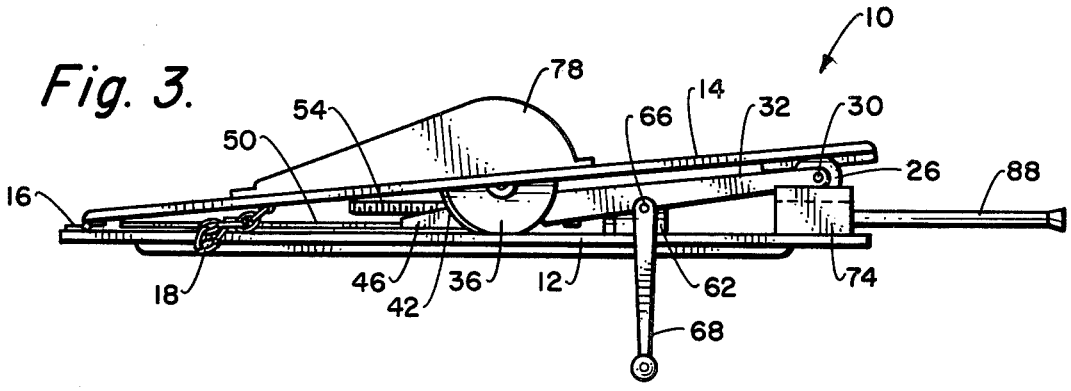
FIG. 3 is a right side view of the backrest of this invention showing the device in the fully collapsed position in which the patient using the device will assume an almost prone position.
Figure 6:
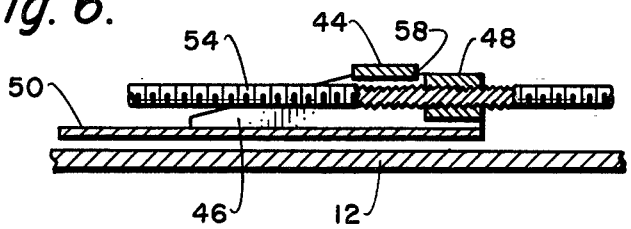
FIG. 6 is a cross-sectional view through a portion of the crank mechanism employed in conjunction with this invention taken along line 6—6 of FIG. 2.
Figure 2:
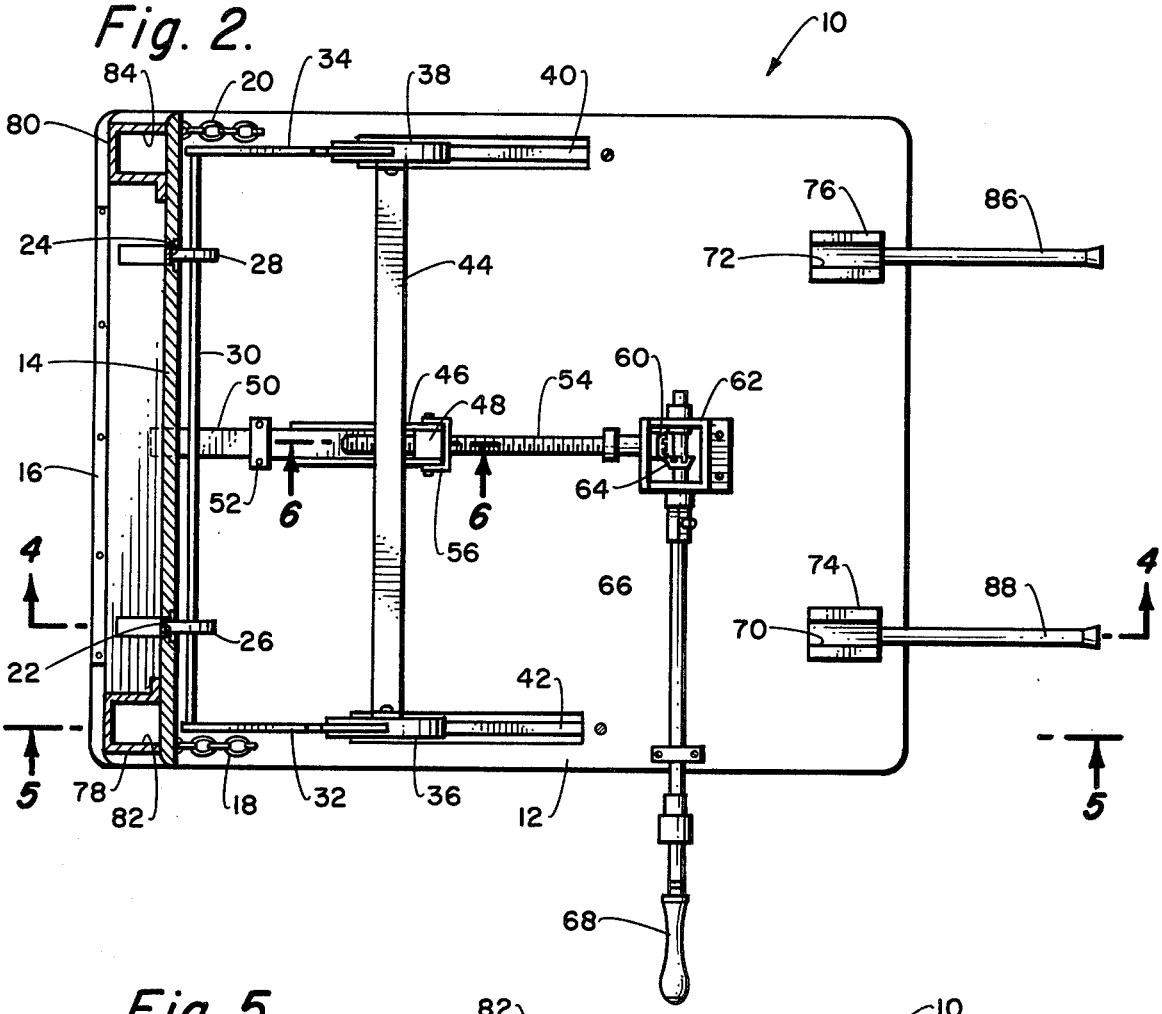
FIG. 2 is a top plan view, partly in cross-section, of the backrest device of this invention taken along line 2—2 of FIG. 1.
Figure 5:
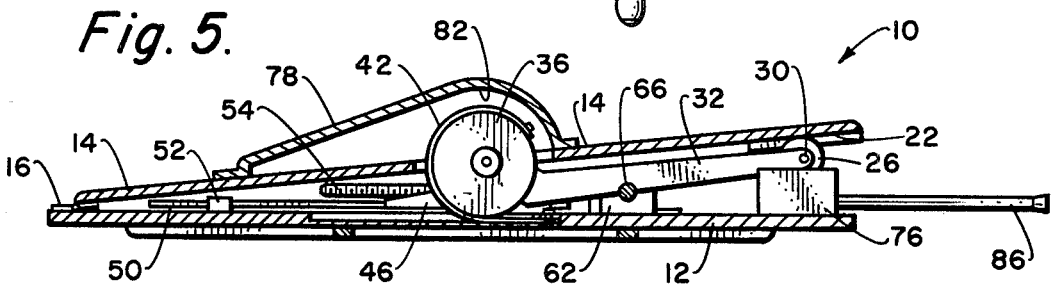
FIG. 5 is a side cross-sectional view in the same direction as FIG. 4 but taken along line 5—5 of FIG. 2.
Figure 4:
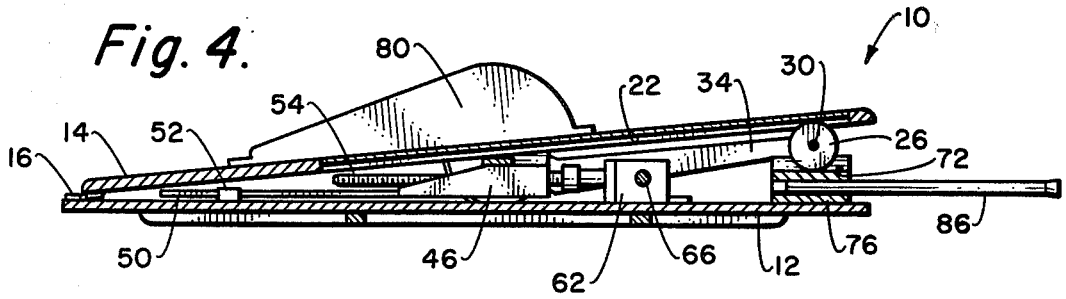
FIG. 4 is a view similar to FIG. 3 but in cross-section taken along line 4—4 of FIG. 2.

It is also to be noted that within the collapsed position of FIGS. 3, 4 and 5 that the discs 36 and 38 are to be located within the interior chambers 82 and 84 of members 78 and 80, respectively. The members 78 and 80 also function as a lateral restraint to provide lateral support for a person leaning against the front side of the backrest panel 14.

When that party is pressing against the front side of the backrest panel 14, the overall structure has a tendency to move in a rearward direction. In order to brace the device 10 in the rearward direction a pair of elongated stop members 86 and 88 are employed each of which are fixedly located within members 76 and 74, respectively. The free end of the elongated stop members 86 and 88 are to come into contact with a fixed object such as a wall or the like.

It is to be understood that the device for this invention could be readily adapted to be employed with various attachments such as serving trays, headrests, armrests and the like. These attachments could be connected to the device in any one of various ways.

What is claimed is:

1. A portable, adjustable backrest adapted for use on a bed, sofa or the like comprising:

a base adapted to be placed upon a planar supportive surface such as a bed, sofa or the like, said base having a fore end and an aft end;

a backrest panel being hingedly connected to said fore end of said base, said backrest panel being pivotable from a first position approaching abutting contact with said base to a second position approaching perpendicular to said base, said backrest panel having a front side and a backside;

means for moving said backrest panel from said first position to said second position, said means includes an arm assembly in continuous contact by contact means with said backside of said backrest panel, said arm assembly being movable along the surface of said backside by a drive means, said drive means being mounted on said base, whereby upon operation of said drive means said arm assembly being moved causing pivoting of said backrest panel;

said drive means including a disc assembly, said disc assembly being fixed to said arm assembly, said disc assembly being pivotable to thereby cause pivoting of said arm assembly; and a flexible strap assembly comprising at least one elongated strap, one end of said strap being fixed to said disc assembly with the other end of said strap being fixedly attached to said base, whereby longitudinal movement of said disc assembly results in said disc assembly rolling upon said strap assembly thereby causing pivoting of said disc assembly and pivoting of said arm assembly.

2. The portable, adjustble backrest as defined in claim 1 including:

stop means mounted on said base adjacent said aft end, said stop means extending exteriorly of said base, said stop means being adapted to physically contact a fixed object so as to brace said backrest and prevent movement of such during use.

3. The portable, adjustable backrest as defined in claim 1 including:

lateral restraint means mounted on said front side of said backrest panel, said lateral restraint means functioning to laterally restrain the user of said backrest and keep the user located at an upright sitting position.

4. The backrest as defined in claim 1 wherein:

stop means located between said backrest panel and said base to limit the movement of said backrest panel to said second position.

5. The backrest as defined in claim 1 wherein:

said contact means comprising a roller assembly, said roller assembly to low-frictionally roll upon said back side of said backrest panel.

6. The backrest as defined in claim 5 wherein:

said roller assembly cooperating within a guiding groove assembly formed within said backside of said backrest panel.

7. A portable, adjustable backrest adapted for use on a bed, sofa or the like comprising:

a base adapted to be placed upon a planer supportive surface such as a bed, sofa or the like, said base having a fore end and an aft end;

a backrest panel being hingedly connected to said fore end of said base, said backrest panel being pivotable from a first position approaching abutting contact with said base to a second position approaching perpendicular to said base, said backrest panel having a front side and a backside;

means for moving said backrest panel from said first position to said second position, said means includes an arm assembly in continuous contact by contact means with said backside of said backrest panel, said arm assembly being movable in respect to said backrest panel by a drive means, said drive means being mounted on said base, whereby upon operation of said drive means said arm assembly being moved causing pivoting of said backrest panel;

a flexible strap assembly comprising at least (in number) elongated strap, one end of said strap being fixed to said disc assembly with the other end of said strap being fixedly attached to said base, whereby longitudinal movement of said disc assembly results in said disc assembly rolling upon said strap assembly thereby causing pivoting of said disc assembly and pivoting of said arm assembly; and said drive means further includes a manually operable crank arm assembly, said crank arm assembly to effect rotation of an elongated screw thread, a nut assembly movably mounted upon said elongated screw thread, said nut assembly being fixedly secured to said disc assembly, whereby upon manual operation of said crank arm assembly the said disc assembly is moved lineally which in turn causes pivoting of said disc assembly.

8. The backrest as defined in claim 7 wherein:

said contact means comprising a roller assembly, said roller assembly to low-frictionally roll upon said back side of said backrest panel;

said roller assembly cooperating within a guiding groove assembly formed within said back side of said backrest panel.

* * * * *

UNITED STATES PATENT AND TRADEMARK OFFICE

CERTIFICATE OF CORRECTION

PATENT NO. : 4,185,342

DATED : January 29, 1980

INVENTOR(S) : Raymond E. Young

It is certified that error appears in the above-identified patent and that said Letters Patent are hereby corrected as shown below:

Column 1, line 46, after "is" insert --- in ---.
Column 1, line 52, "in" should read --- on ---.
Column 4, line 30, after "one" insert --- (in number) ---.
Column 4, line 38, "adjustble" should read --- adjustable ---.
Column 5, line 17, after "least" insert --- one ---.

Signed and Sealed this

*Sixth* Day of *May 1980*

[SEAL]

*Attest:*

SIDNEY A. DIAMOND

*Attesting Officer*

*Commissioner of Patents and Trademarks*